United States Patent [19]

Kimura

[11] 4,336,082

[45] Jun. 22, 1982

[54] TIN-RICH LEAD-BRONZE BASED FORGED AND ROLLED MATERIALS

[76] Inventor: Tadao Kimura, No. 1-6-207, Sakurajyosui 1-Chome, Setagaya-ku, Tokyo, Japan

[21] Appl. No.: 140,822

[22] Filed: Apr. 16, 1980

[30] Foreign Application Priority Data

May 29, 1979 [JP] Japan ..... 54-66657

[51] Int. Cl.[3] ..... C22C 9/02; C22C 9/08; C22F 1/08

[52] U.S. Cl. ..... 148/433; 148/11.5 C

[58] Field of Search ..... 75/156, 156.5, 163; 148/11.5 C, 32

[56] References Cited

U.S. PATENT DOCUMENTS

| | | | |
|---|---|---|---|
| 2,349,945 | 5/1944 | Dodd | 75/156 |
| 2,460,991 | 2/1949 | Le Brasse et al. | 75/156 |
| 2,802,733 | 8/1957 | Bungardt | 75/156.5 |
| 3,544,314 | 12/1970 | Bazley | 75/163 |
| 3,730,705 | 5/1973 | Latrobe | 75/156 |
| 4,243,437 | 1/1981 | Chill et al. | 148/11.5 C |

FOREIGN PATENT DOCUMENTS

| | | | |
|---|---|---|---|
| 461350 | 2/1937 | United Kingdom | 148/11.5 C |

*Primary Examiner*—Peter K. Skiff

*Attorney, Agent, or Firm*—McCormick, Paulding & Huber

[57] ABSTRACT

A tin-rich lead-bronze based forged and rolled material consisting of 9–12% of Sn, 2–8% of Pb, 1–2% of Ni and 88–78% of Cu, Pb is allowed to exist in a finely dispersed condition at the grain boundaries in the α-phase of the Cu-Sn-Ni ternary equilibrium diagram. Such finely dispersed condition is stabilized by forging and rolling to provide a texture substantially free of segregation.

1 Claim, 4 Drawing Figures

TIN-RICH LEAD-BRONZE BASED FORGED AND ROLLED MATERIALS

This invention relates to tin-rich lead and bronze based forged and rolled materials, and more particularly to cold forged and rolled materials composed of copper-based tin-nickel-lead alloys.

Generally, soft type of alloys are preferred for use as bearing material for preventing wear of spindles, particularly those used under the high-speed, high-temperarture and high-pressure conditions, and for this reason, copper-lead sintered alloys are prevalently employed for bearing material. H or EH materials with small coefficient of friction and high hardness are particularly favored for high-pressure shafts and bearings in air-actuated apparatuses, hydraulic apparatuses and the like or for the shafts and bearings used in such devices as miniature motors, time-pieces, electronic computers, etc.

However, the copper and lead based sintered materials, like their forgings, tend to cause segregation of lead, and they also have no plasticity and are low in pressure resistance. Further, if lead is contained more than 0.05% in copper, the former separates out, and only in the case of molten forgings, lead may separate out stably between the crystal particles of copper; unstable precipitation of lead takes place when such material is forged or rolled, and hence usually forging or rolling of such material is impossible.

As for the lead-containing alloy base, there are already known the alloys containing 88–90% of Cu and 10–12% of Sn and having a base with sufficient plasticity and high wear resistance. However, these alloys, even though available in a stable form as forging material, can not be immediately subjected to forging or rolling.

An object of this invention is to provide a copper-based alloy composition containing 9–12% of tin (Sn), 1–2% of nickel (Ni) and 2–8% of lead (Pb), whereby it is intended to provide required plasticity to the base while allowing lead to separate out stably at the grain boundaries when cast, the material being further forged to promote growth of the material itself, which is a feature of this invention, and then subjected to rolling to obtain a product of the desired quality. The thus obtained material is markedly enhanced in mechanical strength and seizing resistance as compared with the cast material and finds best application as shaft and bearing material which is required to have a small friction coefficient.

Other objects and features of this invention will become apparent as the invention is further described hereinbelow with reference to the accompanying drawings, in which.

Figure 1:
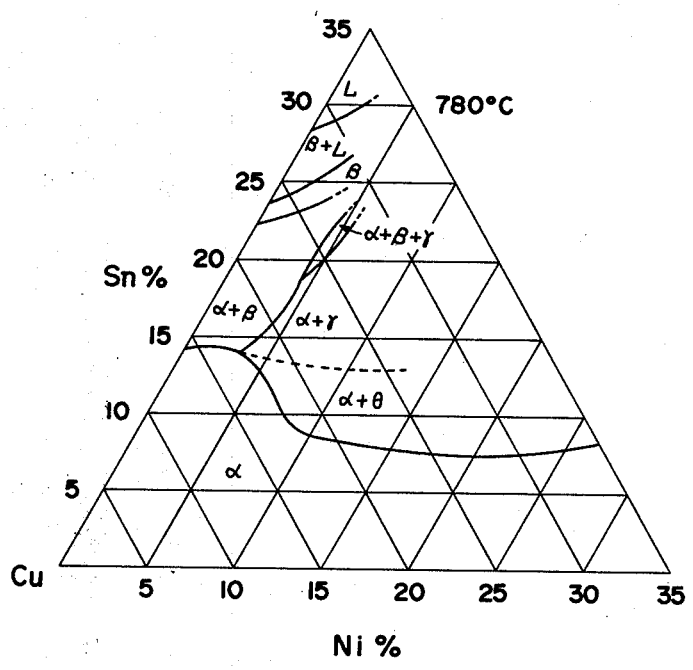
FIG. 1 is a Cu-Sn-Ni ternary equilibrium diagram.

The alloy composition of this invention consists of 88 to 78%, preferably 84.5% of Cu, 9 to 12%, preferably 10% of Sn, 1 to 2%, preferably 1.5% of Ni and 2 to 8%, preferably 4% of Pb, and the texture of this composition is of the structure in which Pb separates out in the form of fine particles in the $\alpha$ phase in the Cu-Sn-Ni ternary equilibrium diagram of FIG. 1 and such particles are generally uniformly dispersed. This alloy, when added with 9–12% of tin, is markedly enhanced in plasticity, and addition of 1–2% of nickel promotes finer division and spheroidization of the crystal particles, while addition of 2 to 8% of lead increases plasticity as well as wear and seizing resistance. Owing to the presence of said quantity of Sn, Pb is stably dispersed in the highly plastic base, and such alloy texture won't be destroyed not only by initial casting but also by ensuing, forging and rolling works, and there is consequently obtained a forged texture which has been grown and fixed by forging.

For obtaining the castings and further the forged and rolled materials having a stable texture from said alloy composition, it is essential to have Pb generally uniformly dispersed in the form of finely divided particles in the molten metal which forms the $\alpha$ phase of the Cu-Sn-Ni system and to make proper temperature control so as not to allow segregation of Pb. It is also necessary to promote plasticity of the alloy base and, particularly, to remove the phosphorus compounds. Further, the solid solution treatment, casting, forging and rolling must be performed in association with each other harmoniously and systematically so as to inhibit segregation of Pb and formation of the dendrite in the alloy phase. Sufficient growth and fixing of the forged texture in the forging step are also essential.

For producing the material of this invention, 2–8% of finely divided Pb is fused and dispersed in a molten metal of the $\alpha$ phase in a ternary 88–78% Cu, 9–12% Sn and 1–2% Ni alloy to form an ingot, and this ingot is cast according to a non-oxidizing type continuous casting system, then subjected to repeated alternate cold forging and heat treatment to grow the forged alloy texture and fix the formed stable forged texture and finally subjected to a rolling work to keep the stable texture protected against failure.

By using the thus obtained material, it is possible to produce the drawn pipe blanks with minimum outer diameter of 2.5 mm and minimum inner diameter of 2.0 mm as well as the hyper-thin rolled plate blanks with minimum thickness of 0.02 mm.

The invention is now described by way of an embodiment thereof.

First, a pipe ingot is formed according to a continuous casting system. For this operation, Cu (84.5), Ni (1.5), Sn (10) and Pb (4) are fused in that order at 1,250° C., and while deacidifying the mixture during this fusing operation (adding 0.02% of Li as deacidifying agent), the mixture is subjected to non-acidifying type continuous casting to form a pipe ingot. During this casting operation, removal of impurities at the grain boundaries and intensification of intergrannular strength are effected by addition of Li and Ca.

Then, this ingot is subjected to cold forging to let grow and fix the forged texture. In case of finishing a cast pipe material of a suitable length (l) with, for example, outer diameter of 50 mm, inner diameter of 38 mm and thickness of 6 mm, into a product with outer diameter of 40 mm, inner diameter of 36 mm, thickness of 2 mm and a suitable length (l), the forging operation is carried out by using at least five forging steps at a temperature of 600–900° C. and under forging pressure of 100–250 t/cm$^2$ such that the overall working rate would become higher than 60%. This forging operation and heat treatment are repeated alternately to expedite growth of the texture and to fix the stable forged texture. This pipe forging is then subjected to drawing to finish it into a product with desired dimensions. It is possible to finish the material of this invention into the pipes ranging from the maximum dimensions of 40 mm outer diameter, 36 mm inner diameter and 2 mm thickness to the minimum dimensions of 2.5 mm outer diameter, 2 mm inner diameter and 0.5 mm thickness.

The 50% worked H material of the thus formed pipe blank has the following standard properties:

Specific gravity: 8.7
Tensile force: 100 kg/mm$^2$
Elongation: 20%
Vickers hardness (HV): 250
Modules of elasticity: $1.1\times10^4$ kg/mm$^2$
Electric conductivity: 19υ/cm It will be seen that the material has high tensile strength and elongation and is tough.

Figure 2:
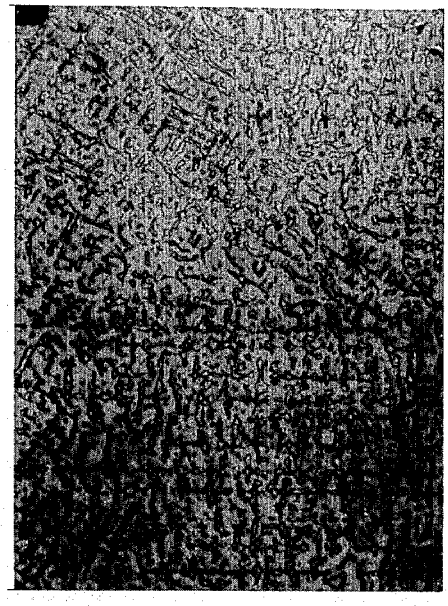
FIG. 2 is a 150 times magnified photograph of the texture of a pipe casting obtained from a continuous casting work.
Figure 3:
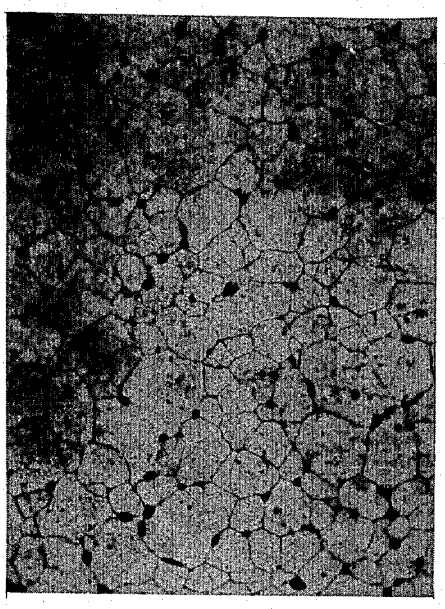
FIG. 3 is a 150 times magnified photograph of the texture of which the growth has been completed by repeated alternate forging and heat treatment.
Figure 4:
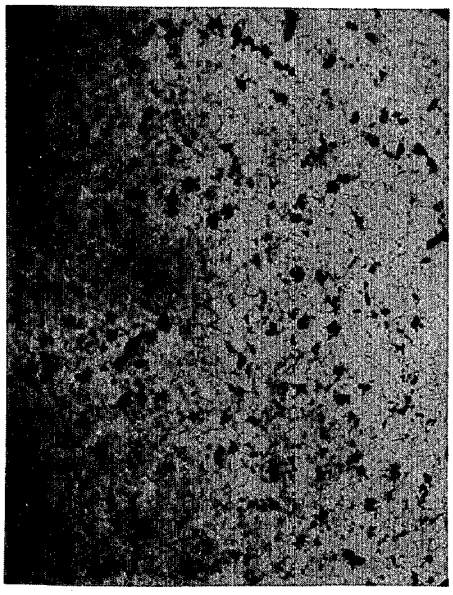
FIG. 4 is a 150 times magnified photograph of the texture of a worked alloy material obtained by subjecting the material of FIG. 3 to a 40% working (such as by rolling or drawing).

The microphotographs of the textures of the alloys according to this invention are shown in FIGS. 2 to 4. As apparent from these photographs, the Cu-Sn-Ni base texture is dense and compact, Pb is dispersed uniformly, and there takes place no segregation not only after casting but also when the material is subjected to forging and drawing.

Thus, the alloys of this invention have dense and stable base (Cu-Sn-Ni) and are high in plasticity owing to the presence of Sn. Also, since Pb is uniformly dispersed and no segregation takes place, the forged materials using such alloys are tough and resistant to cracking and also have moderate softness and conformability, so that these materials prove to be best suited for use as shaft and bearing materials.

According to this invention, Sn is contained in a high proportion in the Cu-Sn-Ni ternary alloy base, Pb is stably dispersed in this base and there takes place no segregation of Pb, so that the materials provided according to this invention are featured by (1) high hardness and tensile force, (2) dense crystal texture and good condition thereof, (3) generally uniform dispersion of lead in particulate form and improved bearing characteristics, and (4) small coefficient of friction, and hence they find best application as shaft and bearing material. Thus, the product of this invention can best be applied as H or EH material for shafts and bearings used under the high-speed, high-temperature and high-pressure conditions or those used in such devices as miniature motors, timepieces, electronic computers, etc.

What is claimed is:

1. A tin-rich lead-bronze based forged and rolled material consisting of 9–12% of Sn, 2–8% of Pb, 1–2% of Ni and 88–78% of Cu, wherein Pb is allowed to exist in a finely dispersed condition at the grain boundaries in the α-phase of the Cu-Sn-Ni ternary equilibrium diagram and such finely dispersed condition is enhanced and stabilized by alternate forging and heat treatment to grow and fix a forged texture substantially free of segregation and then working the forged and heat treated material by an amount of at least 40% without intermediate heat treatment to retain and protect the stabilized texture.

* * * * *